US007424998B1

(12) United States Patent
Barney

(10) Patent No.: US 7,424,998 B1
(45) Date of Patent: Sep. 16, 2008

(54) MOTORIZED LIFTER

(76) Inventor: John Barney, 111 Cambridge Dr., McMurray, PA (US) 15317

( * ) Notice: Subject to any disclaimer, the term of this patent is extended or adjusted under 35 U.S.C. 154(b) by 125 days.

(21) Appl. No.: 10/667,673

(22) Filed: Sep. 22, 2003

(51) Int. Cl.
*B66D 1/36* (2006.01)

(52) U.S. Cl. ..... 254/334; 254/329; 294/110.1; 294/118; 414/618; 414/626

(58) Field of Classification Search ..... 254/329, 254/334, 362; 294/110.1, 116–119, 902; 414/460, 911, 618, 786, 626; 212/270, 274, 212/275, 213, 221, 319
See application file for complete search history.

(56) References Cited

U.S. PATENT DOCUMENTS 4,496,063 A 1/1985 Ishii et al.
4,743,056 A 5/1988 Oliason
5,477,121 A 12/1995 Sirjola
5,769,250 A 6/1998 Jussila et al.
5,841,256 A 11/1998 Oja et al.
6,014,007 A 1/2000 Seibel et al.
6,293,747 B1 9/2001 Thomas
6,331,025 B1 12/2001 Douglas

*Primary Examiner*—Emmanuel M Marcelo
(74) *Attorney, Agent, or Firm*—K & L Gates LLP

(57) ABSTRACT

A lifter including tongs; an electric motor having a stator, a rotor, and one or more windings and a shaft operatively coupled with the first tongs for actuating the first tongs to an open position for receiving a load and actuating the first tongs to a closed position for engaging the load; and a vector drive controller electrically coupled to the electric motor for controlling the operation of the electric motor. A method of handling a load with a motorized lifter including at least one set of tongs and an electric motor coupled to the tongs, the method including moving the tongs of the motorized lifter to a home position by operation of the electric motor, wherein the electric motor is controlled by a vector drive controller; moving the tongs out of the home position; placing the tongs over the load; and positioning the tongs against the load by operation of the vector drive controlled electric motor so as to frictionally engage the load with the tongs.

52 Claims, 13 Drawing Sheets

MOTORIZED LIFTER

DESCRIPTION OF THE BACKGROUND

In heavy duty manufacturing environments it is often necessary to handle, e.g., lift, support, and transport, heavy loads by an overhead traveling crane provided with some type of load engaging lifting apparatus. For example, in the manufacture of steel, molten steel from a basic oxygen furnace is cast into ingots either individually or by a continuous casting process. The ingots are then forged into slabs, blooms or billets depending on the final product to be manufactured, each ingot being a heavy load to be handled by an overhead traveling crane. The slabs, blooms, and billets form heavy loads that, at one time or another, must be lifted, supported, and transported from one location of a steel mill to another for further processing. For example, slabs manufactured by a continuous casting line are usually conveyed by a conveyer roller table to a piler delivery table, and piled in a slab yard by an overhead traveling crane having a load engaging apparatus in the form of a slab grip lifter. The slabs may be placed in the slab yard for storage or may be placed on a vehicle to be transported to another location, e.g., a furnace, another steel mill, and the like. An operator or a computer-controlled loader may load and unload the slabs to and from the slab grip lifter. This process may be conducted by an operator or may be automatic.

A conventional load engaging lifter apparatus most often employs one or more pairs of tongs having scissors-like linkages and jaws for grasping single or stacked heavy loads such as the steel slabs, blooms, and billets described above. Each set of tongs may be equipped with two or more pairs of arms for lifting and handling the heavy loads. Conventional load-engaging lifting apparatuses also include one or more bails for receiving a crane hook of an overhead traveling crane. When the tongs are lowered onto a load, the jaws are placed in a fully opened position, e.g., they are opened in an outward direction away from the load so as to provide an adequate opening for receiving the load. When the load is ready to be lifted, the jaws are closed inwardly, e.g., towards the load, until they contact the load. The overhead traveling crane then lifts the load engaging lifter upwards by means of the crane hook(s) placed through the bail(s). The upward movement of the lifter in combination with the weight of the load collapses the scissors like linkages of the lifter and thus draws together the jaws of the tongs in a fully clamped position against the load. The gripping power is generally mechanical and self-pressing against the load according to the weight of the load being lifted. Once the load is fully engaged in this manner, it is ready to be safely lifted, supported, and transported by the overhead traveling crane to a desired location.

There also exist motorized lifters for handling heavy loads. In such motorized systems, a motorized hoist is used to open and close the jaws of the one or more tongs of the load engaging lifter. Once the motorized hoist closes the lifter's jaws against the load, the gripping power is mechanical and self-pressing against the load according to the weight of the load.

The motorized lifters generally employ an electric motor that may be a DC or AC type motor for opening and closing the tongs. The conventional electric motors, however, suffer several disadvantages. A DC motor includes a commutator with brushes to supply electrical current. Brushes require maintenance and can lead to higher maintenance and repair costs. Furthermore, a DC motor has a limited dynamic response due to line commutation restrictions, coupled with higher mass moments of inertia imposed by the wound field armature. Also, commutation restrictions further limit the range of horsepower in which a DC motor can operate. Additionally, in a DC motor there always exist a potential for rapid acceleration to destructive velocities upon the loss of the stationary field.

SUMMARY

In one general respect, the present invention is directed in one embodiment to a lifter, including tongs that include a set of levers; an electric motor operatively coupled with the tongs for actuating the tongs; and a vector drive controller electrically coupled to the electric motor for controlling the operation of the electric motor.

According to another embodiment, the present invention is directed in one embodiment to a lifter, including tongs including a set of levers attached to vertically spaced apart top and bottom transverse beams for supporting the tongs; and a motorized hoist assembly attached to the top beam for synchronously controlling the opening and closing of the tongs; wherein the motorized hoist further may include an electric motor having a stator, a rotor, and one or more windings and a shaft operatively coupled with the first tongs for actuating the tongs to an open position and actuating the tongs to a closed position; and a vector drive controller electrically coupled to the electric motor for controlling the operation of the electric motor.

In another general respect, the present invention is directed in one embodiment to an overhead traveling crane, including a motorized lifter; wherein the motorized lifter further may include tongs attached to vertically spaced apart top and bottom transverse beams for supporting the tongs; and a motorized hoist assembly attached to the top beam for synchronously controlling the opening and closing of the first tongs; wherein the motorized hoist further may include an electric motor having a stator, a rotor, and one or more windings and a shaft operatively coupled with the tongs for actuating the tongs to an open position and actuating the tongs to a closed position; and a vector drive controller electrically coupled to the electric motor for controlling the operation of the electric motor.

In another general respect, the present invention is directed in one embodiment to a method of handling a load with a motorized lifter including at least one set of tongs and an electric motor coupled to the tongs, the method including moving the tongs of the motorized lifter to a home position by operation of the electric motor, wherein the electric motor is controlled by a vector drive controller; moving the tongs out of the home position; placing the tongs over the load; and positioning the tongs against the load by operation of the vector drive controlled electric motor so as to frictionally engage the load with the tongs.

DESCRIPTION OF THE DRAWINGS

Embodiments of the present invention are described herein in conjunction with the following figures, wherein.

DESCRIPTION

Figure 1:
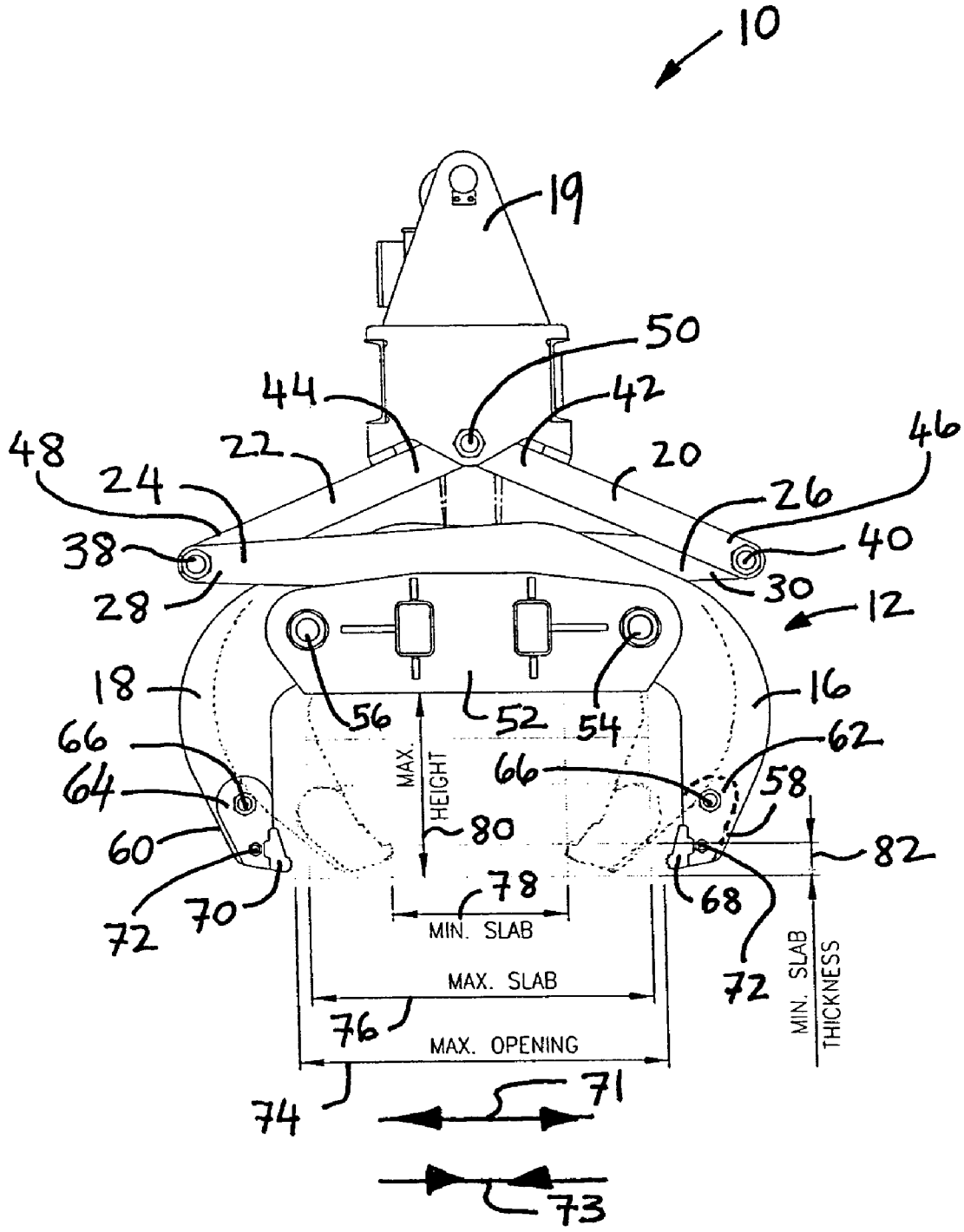
FIG. 1 is a front view of a motorized lifter according to one embodiment of the present invention.
Figure 2:
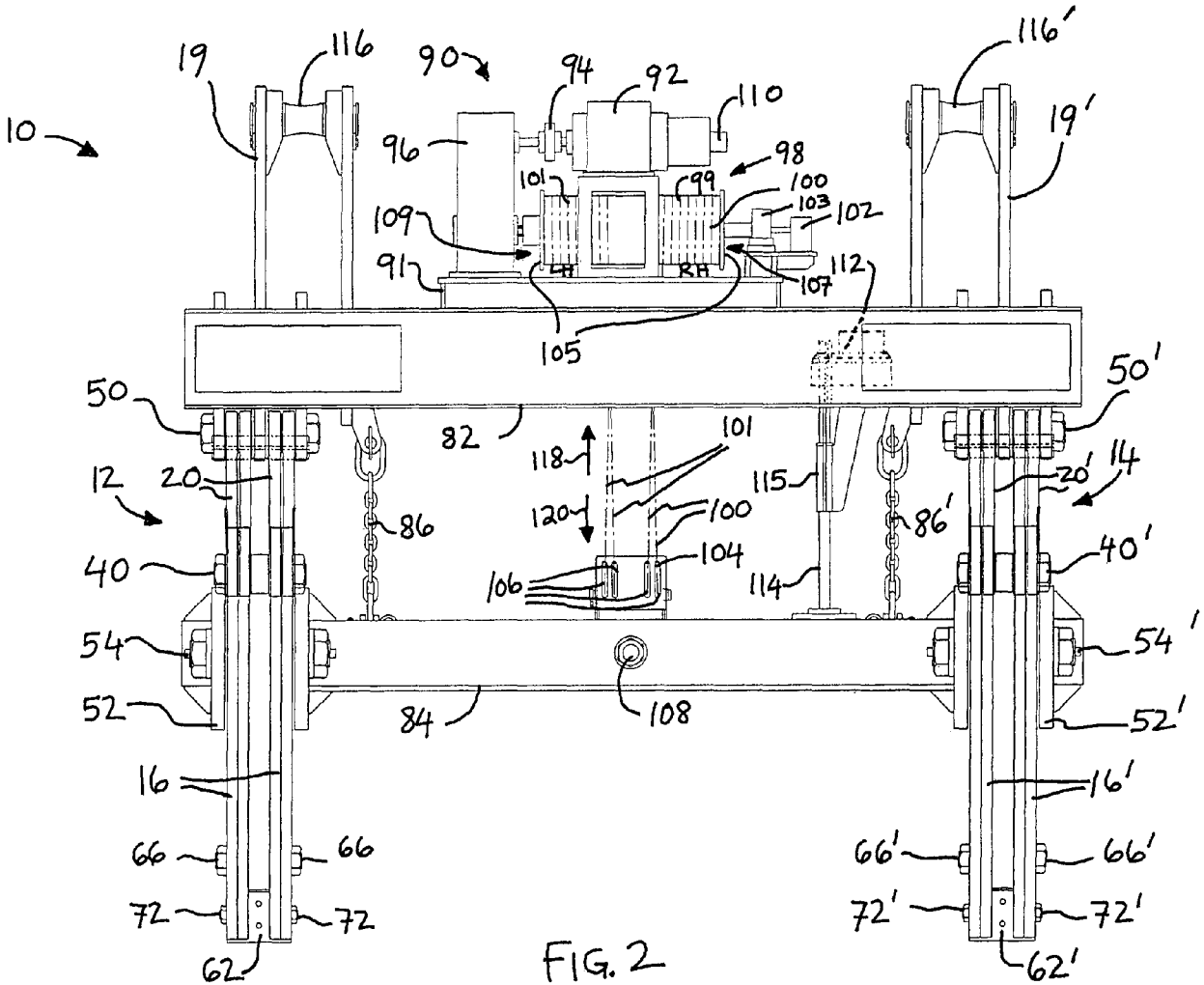
FIG. 2 is a side view of the motorized lifter shown in FIG. 1.

FIGS. 1 and 2 illustrate a front view and a side view, respectively, of a motorized lifter 10 according to one embodiment of the present invention for frictionally engaging, or otherwise retainingly grasping, a load. Although specific embodiments of the invention will be described with respect to the motorized lifter 10 for engaging, lifting, supporting, and transporting steel slabs, the scope of the invention is not intended to be limited thereto. For example, the present invention may be modified or adapted for handling various types of loads in addition to steel slabs such as blooms, billets, coils, ladles, structural components such as I-beams, concrete barriers and the like. Accordingly, in one embodiment of the present invention, the motorized lifter 10 is adapted for frictionally engaging, lifting, supporting, and transporting one or more slabs held between the first tongs 12 and second tongs 14 (shown in FIG. 2). The first and second tongs 12, 14 are synchronously actuated into open and closed positions by a motor 92 (shown in FIG. 2). The motorized lifter 10 also may include a first bail 19 and a second bail 19' (shown in FIG. 2) adapted for receiving a crane hook for lifting and transporting the one or more slabs by an overhead traveling crane while being held or supported between the first and second tongs 12, 14.

The first tongs 12 will now be described with reference to FIG. 1. Accordingly, the first tongs 12 include a jaw-like structure comprising first and second opposing arms, indicated respectively, at 16 and 18, and first and second straight link members 20 and 22. The first and second opposing arms 16 and 18 may include, respectively, a set of levers such as first and second levers 24 and 26, which may be formed integrally therewith. The first lever 20 may include a proximate end 28 and a pivotally movable juncture 38. The second lever 26 may include a proximate end 30 and a pivotally movable juncture 40.

The first and second straight link members 20, 22 each include, respectively, proximate ends 42 and 44 and distal ends 46 and 48. The distal end 46 of the first straight link member 20 may be pivotally attached to the proximate end 30 of the second lever 26 by a pivot pin at the one pivotally moveable juncture 40. The distal end 48 of the second straight link member 22 may be pivotally attached to the proximate end 28 of the first lever 24 by a pivot pin at the other pivotally moveable juncture 38. A pivot pin at yet another pivotally moveable juncture 50 may pivotally attach the proximate ends 42 and 44 of the first and second straight link members 20 and 22, to each other.

The first and second opposing arms 16 and 18 may be pivotally attached to a cross bar 52 at pivotally moveable junctures 54 and 56, respectively. The first and second opposing arms 16 and 18 each include distal ends 58 and 60 that include first and second jaw elements 62 and 64, respectively, attached thereto by fasteners 66 such as, for example, a stud and a jam nut. The first and second jaw elements 62 and 64 may include first and second tong points 68 and 70, respectively, adapted for contacting and frictionally engaging steel slabs gripped therebetween. The first and second tong points 68 and 70 may be attached to the to the jaw elements by fasteners 72 such as, for example, a stud and jam nut.

The first and second opposing arms 16, 18 may move synchronously in an outward direction 71 and in an inward direction 73 by the operation of the motor 92 (shown in FIG. 2). Before engaging or grasping a steel slab or a stack of slabs, the first and second opposing arms 16, 18 may be opened in the outward direction 71 to a maximum fully opened position 74, be positioned over the slab, and then be lowered onto the slab. When the slab is ready to be lifted, the first and second opposing arms 16, 18 are moved in the inward direction 73 until the first and second tong points 68, 70 contact the slab. A given pair of tongs 12 and 14 may be configured to grip a specific size and shape of load. For example, the tongs 12 and 14 may accommodate slabs having a maximum width 76, a minimum width 78, a maximum height 80, and a minimum thickness 82 that varies widely depending on the specific application. The proportions, widths, heights, and thicknesses shown herein are for illustration purposes only and the present invention is not intended to be limited thereto.

FIG. 2 illustrates a side view of the motorized lifter 10 shown in FIG. 1 including a view of the second tongs 14. Corresponding elements of the second tongs 14 that are similar to the elements of the first tongs 12 are assigned the same reference numerals as the first tongs 12 followed by a prime (') symbol. The partial view of the second tongs 14 shows, for example, the first arm 16', the first link member 20', junctures 40' and 54', and fasteners 66' and 72' for attaching the jaw element 62' to the first arm 16'. Also shown in FIG. 2 are a second bail 19' and first and second spools 116 and 116' for receiving and engaging a crane hook (not shown). A further description of the second tongs 14 is deemed to be unnecessary because in one embodiment, there is a symmetrical relationship between the first and second tongs 12 and 14.

The motorized lifter 10 also may include vertically spaced apart top and bottom transverse beams 82 and 84, linked by chain assemblies 86 and 86' for supporting the first and second tongs 12, 14. The top beam 82 also supports one embodiment of a motorized hoist assembly 90 for synchronously controlling the opening and closing of the first and second tongs 12, 14 according to the present invention. The motorized hoist assembly 90 may be rigidly attached to the top beam 82 by a built-up rigid base frame 91. In one embodiment, the rigid base frame 91 may be fabricated of all welded steel construction with a rib reinforced solid deck plate that provides a common base for the motorized hoist assembly 90. The built-up rigid base frame 91 may provide efficient heat dissipation that may help to extend the life of the motorized hoist assembly 90. Furthermore, the built-up rigid base frame 91 may provide quick and easy access to all the components of the motorized hoist assembly 90, thus simplifying routine maintenance operations.

In one embodiment of the present invention, the motorized hoist assembly 90 may include an electric motor. Embodiments of the present invention may incorporate a variety of electric motors such as, for example, AC or DC motors or other types of electric motors. Furthermore, embodiments of the present invention may incorporate a variety of motor control schemes including, for example, AC or DC motor control schemes without departing from the scope of the invention. As an illustrative example, one embodiment of the present invention will now be described with respect to a balanced three-phase variable speed vector drive controlled alternating current ("AC") induction motor 92 ("AC induction motor"). The vector drive AC induction motor 92 is available in a totally enclosed blower cooled housing with an attached constant velocity fan or is available in a totally enclosed non-ventilated housing. The AC induction motor 92 may be supplied with a 1024 line count digital encoder to provide feedback to the AC vector drive controller such as output shaft rotational position, shaft speed, and the like. Horsepower may be available from 1 through 500 HP in NEMA frame sizes from 56C through 5009L. The AC motor 92 may be suitable for industrial applications that require exact speeds and positioning and full torque from base speed down to zero speed.

One example of an electric motor that may be employed in one embodiment of the motorized hoist 90 according to the present invention is a variable speed vector drive controlled motor AC induction motor manufactured by the Baldor Electric Company. One embodiment of the AC induction motor 92 may include a continuous duty rated motor capable of developing a 15 Horsepower (HP) output at 1760 Revolutions Per Minute (RPM) from a 460 Volt, 3-Phase, 60 Hz input AC power supply, for example. Those skilled in the art will appreciate, however, that higher or lower horsepower electric motors may be employed without departing from the present invention. The AC induction motor 92 also may include a totally enclosed blower cooled housing and may be cooled by a continuous duty blower motor. The AC induction motor 92 also may include class "H" insulation operating within the temperature limits of class "F" insulation at rated power. Other variable speed vector drive controlled AC motors may be used as called for by a specific application without departing from the scope of the present invention. In one embodiment of the present invention, the AC induction motor 92 may be controlled by an AC variable frequency flux vector drive control system 180, which is described in more detail below with reference to FIGS. 7-9.

The AC induction motor 92 may include a stator and a rotor. The stator may include a three-phase stator winding that forms a cylindrical stator cavity. In one embodiment the rotor may include several layers of conductive strands along its periphery that are short circuited to form conductive closed loops, generally referred to as a "squirrel cage winding." In the squirrel cage winding, axial conductive bars are connected at either end by shorting rings to form a generally cylindrical structure. The rotor is concentrically mounted to rotate within the stator cavity. The stator windings of the AC induction motor 92 may be connected to a power supply having a three-phase form. Applying a voltage across the stator windings of the motor produces a radially rotating magnetic stator field. The voltages provided to the stator generate stator currents that generate the radially rotating magnetic stator field that interacts with the rotor to cause rotation. The three-phase electrical voltages provided to the stator windings force the rotor to rotate within the stator cavity.

The operation of the AC induction motor 92 involves the interaction of magnetic fields of the rotor and the stator. As discussed above, the several layers of conductive strands along the periphery of the rotor are short circuited to form conductive closed loops. The rotating magnetic fields produced by the stator induce a current into the conductive loops of the rotor (hence the name "induction motor"). Accordingly, the radially rotating magnetic field causes forces to act on the current carrying conductors, which results in a torque on the rotor. One advantage of the AC induction motor 92 is that currents flowing in its rotor do not have to be supplied by a commutator, as they are in a DC motor.

More specifically, as the stator field rotates about the stator cavity, stator field flux lines cut across the conductive loops. If the stator field rotates at a speed that is slightly greater than the rotor speed, such that each conductive loop is subjected to a slowly varying stator magnetic field, the stator flux lines induce a current in the conductive loops along the periphery of the rotor. The difference between the velocity of the radially rotating magnetic stator field and the rotor frequencies is generally referred to as "slip."

The radially rotating magnetic stator field rotates at a particular velocity (V) that can be calculated with the following formula:

$$V=120f/p \tag{1}$$

Where "p" is the number of poles and "f" is the frequency. Although the rotor reacts to the rotating magnetic field, it does not travel at the same speed. The rotor speed "slips" or lags behind the speed of the magnetic field. This slip quantifies the slower speed of the rotor in comparison with the speed of the rotating magnetic field. Because the rotor is not locked into any given position and is free to rotate, it will continue to slip throughout the circular motion. The amount of slip increases proportionally with increases in load. Accordingly, in order to generate an accurate velocity profile for operating the motorized hoist 90, in one embodiment of the present invention, the AC induction motor 92 must be controlled by an AC variable frequency flux vector drive control system 180 ("flux vector drive control system," described in detail below with reference to FIGS. 7-9). The flux vector drive control system 180 (shown in FIGS. 7-9) controls the speed and torque of the AC induction motor 92 by controlling the frequency of the AC power supply applied to the windings of the AC induction motor 92. To eliminate or minimize the effects of slip, the AC induction motor 92 may be coupled to a rotary encoder 110 for obtaining a precise measurement of the motor shaft position and speed and providing this measurement to the flux vector drive control system 180 as a feedback signal.

Although the present invention is described with respect to the AC induction motor 92 described above, there are a variety of different types of induction motors differing mainly by the number of phases and the winding type that may be employed without limiting the scope of the present invention. Other induction motors that may be used with alternative embodiments of the present invention include shaded pole, split phase, capacitor start, two value capacitor, permanent split capacitor, two phase, three phase star, three phase delta, and three phase single voltage, for example. As these motors are well known in the art, and any differences between them and the AC induction motor 92 described above will generally be appreciated by those skilled in the art will, a further description of these alternate motors is not presented in the interest of simplifying this explanation.

As discussed above, in one embodiment of the present invention, the variable speed vector drive controlled AC induction motor 92 may be coupled to a rotary encoder 110 for obtaining a precise measurement of the motor shaft position and providing this measurement to the flux vector drive control system 180 as a feedback control signal. For example, the rotary incremental encoder 110 may be coupled to the shaft of the AC induction motor 92 to generate a series of pulses, e.g., square waves, whose number of waves can be made to correspond to the proper required rotation increment of the motor's 92 mechanical shaft. For example, in one embodiment of the present invention, the motor's 92 shaft revolution may be divided into 1000 parts, such that 1000 pulses corresponds to 360 degrees, or one full revolution of the shaft. Accordingly, an encoder may be adapted to provide 1000 square wave cycles per revolution of the shaft. A digital counter may be used to count these cycles to determine how far the shaft has rotated, e.g., 100 counts would equal 36 degrees, 150 counts 54 degrees, and so on. There are a variety of motor shaft position encoders that may be used without departing from the scope of the various embodiments of the present invention. A more detailed description of an embodiment of the rotary encoder 110 is provided below with reference to FIG. 6.

Figure 6:
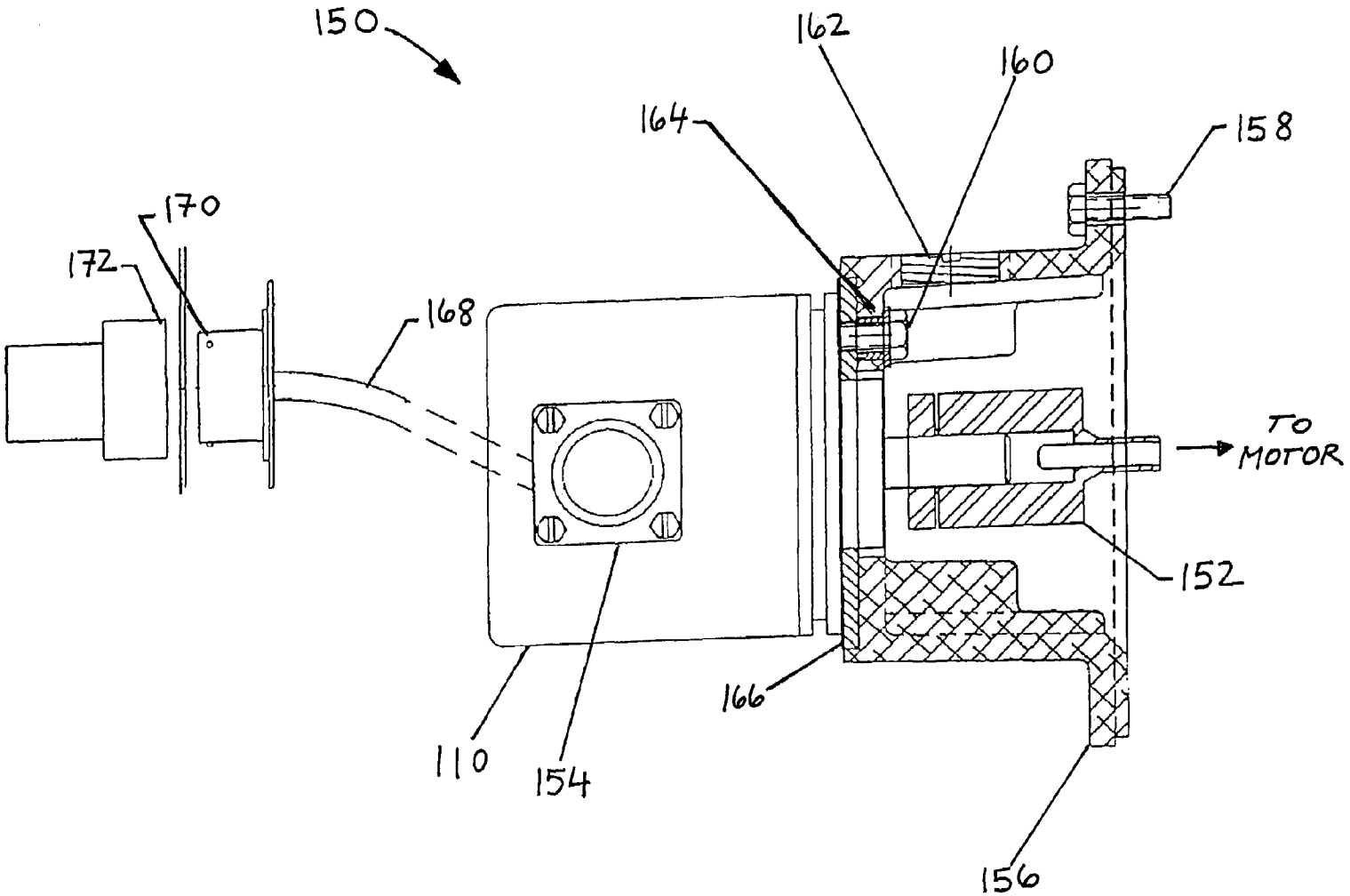
FIG. 6 is a rotary encoder assembly according to one embodiment of the present invention showing a portion thereof in cross-section.

Accordingly, turning now to FIG. 6, an embodiment of a rotary encoder assembly 150 that may be employed in one embodiment of the present invention is shown. The encoder assembly 150 may include, for example, a rotary encoder 110 and a coupling 152 for mounting the rotary encoder 110 to the AC induction motor 92. An encoder mounting adapter plate 156 may be provided to couple the rotary encoder 110 to the AC induction motor 92 using an encoder assembly fastener 158, e.g., a mounting screw. The rotary encoder 110 also is mounted to a mounting board 166 by another fastener 160, which may include an insulating washer 164. The fastener 160 may be accessed through a coupling access plug 162 provided on the adapter plate 156. Electrical signals from the rotary encoder 110 may be provided to an AC flux vector drive controller 182 (shown in FIG. 7) through a connector 154 coupled to a cable 168 that is connected at another end to a connector receptacle 170. A connector plug 172 may be provided to couple the encoder signals to the AC flux vector drive controller 182 (shown in FIG. 7).

Turning back to FIG. 2, in one embodiment of the present invention, the output shaft of the AC induction motor 92 also may be connected to a gear reducer 96 by a coupler 94. In one embodiment of the present invention, the gear reducer 96 may comprise a drive train that may include a triple reduction helical gear speed reducer for reducing the speed of the motor shaft. The reduction gears in the gear reducer 96 may be totally enclosed in an oil bath for lubrication. The first, second, and third reductions include helical gearing mounted in one line bored housing. The helical gears may be precisely machined from forged blanks and then carburized for long service life and quiet operation. In one example implementation, the gearing may be AGMA Class II rated with a 1.83:1 minimum service factor on the actual torque loading.

In one embodiment of the present invention, the output shaft of the gear reducer 96 may be coupled to and may rotate a cable drum 98. The cable drum 98 may include a drum barrel 99 located between two flanges 105. In one example implementation of the present invention, the cable drum 98 may be formed of steel, all welded construction, and may include a pitch diameter of 12½ inches. In one embodiment, the drum barrel 99 may be 34 inches long between flanges 105. Also, in one embodiment the cable drum 98 may be ½ depth precision machined left-hand (LH) and right-hand (RH) grooved to accommodate two ½ inch diameter wire ropes 100, 101 on one layer. From the cable drum 98, the first and second wire ropes 100, 101 may extend to a load block assembly 104, which may be rigidly attached to the bottom beam 84. The load block assembly 104 may include four sheaves 106.

In one embodiment of the present invention, the wire ropes 100, 101 may be formed, for example, of ½ inch diameter 6×37 IWRC XIP steel strands having a nominal strength of 26,600 lbs. with a 6.67:1 factor of safety when supporting a 3,990 lb. load. In one example implementation, each of the wire ropes 100, 101 may have an overall length of 160 feet in one piece with plain welded ends. One end of each of the dual lifting wire ropes 100, 101 is attached to the cable drum 98. From there, the wire ropes 100, 101 may extend to the load block assembly 104, which may be rigidly attached to the bottom beam 84. The ratio of the diameter of the wire ropes 100, 101 to the pitch diameter of the cable drum 98 may be 25:1, for example. The wire ropes 100, 101 may be used to move the lower beam 84 in an "up" direction 118 and a "down" direction 120, thus moving the first and second tongs 12, 14 into an open and a closed position, respectively. With the load (e.g., one or more slabs) in an extreme "up" position in one embodiment the wire ropes 100, 101 may be located 10⅜ inches center-to-center. With the load in an extreme "down" position in one embodiment the wire ropes 100, 101 may be located 26⅜ inches center-to-center. The flanges 105 may serve to allow a clearance equivalent of two diameters of the wire ropes 100, 101 beyond the grooved working layer of the barrel 99, for example. Furthermore, a clamp-type wire rope "dead-end" provision may be included on each of the cable drum flanges 105 and may be secured by a clamp to an outside face of the flanges 105, for example.

In one embodiment of the present invention, the cable drum 98 may include a heavy-duty precision anti-friction four-bolt roller bearing with a heavy-duty fabricated steel stanchion included at one end 107 of the cable drum 98. This may provide smooth and efficient cable drum 98 rotation. The other end 109 of the cable drum 98, which also runs on anti-friction bearings, may be supported directly by the output shaft of the gear reducer 96. In one example implementation, the cable drum 98 support bearing may include shear bars to provide permanent bearing alignment.

In one embodiment of the present invention, the motorized lifter 10 also may include a primary limit switch 112. The limit switch 112 may be coupled to a limit switch weight 114 and a limit switch guide 115. The limit switch 112 may provide a signal to the AC flux vector drive controller 182 (shown in FIG. 7), or a general purpose computer or controller that operates the overhead traveling crane 260 (shown in FIG. 10), that indicates when the first and second tongs 12, 14 have reached a fully opened position 74. In one example implementation, the fully opened position 74 may correspond to the position of the limit switch 112 when the motorized lifter 10 has reached an extreme "up" 118 position referred to generally as the "home position." The limit switch 112 may be a double pole double throw design wherein one set of contacts sets the motor brake 122 (shown in FIGS. 3A and 3C) and may de-energize the AC induction motor 92, while another set of contacts may turn on a light to signal to the operator that the motorized lifter 10 has reached the "home position." The light may be mounted in a cab where the operator is located while operating the motorized lifter 10 or may be mounted in a control room.

In one embodiment of the present invention, the motorized hoist assembly 90 may include a back-up travel rotary limit switch 102 for coordinating reversing operations with the number of revolutions of the driven cable drum 98. In one example implementation, the rotary limit switch 102 may be coupled to the cable drum 98 by a rotary limit switch coupling 103 for optimum accuracy. Because the actual location of the rotary limit switch 102 may be driven by a particular application, the location of the rotary limit switch 102 shown herein is not intended to limit the scope of the present invention. In one embodiment, the limit switch 102 may include a two circuit geared rotary design with a 20:1 gear ratio that provides a secondary upper hoist travel limit shut-off and a secondary lower hoist travel limit shut-off. In one embodiment, the rotary limit switch 102 may be housed in a NEMA-Type 4 gasketed "all-weather" enclosure.

Figure 4:
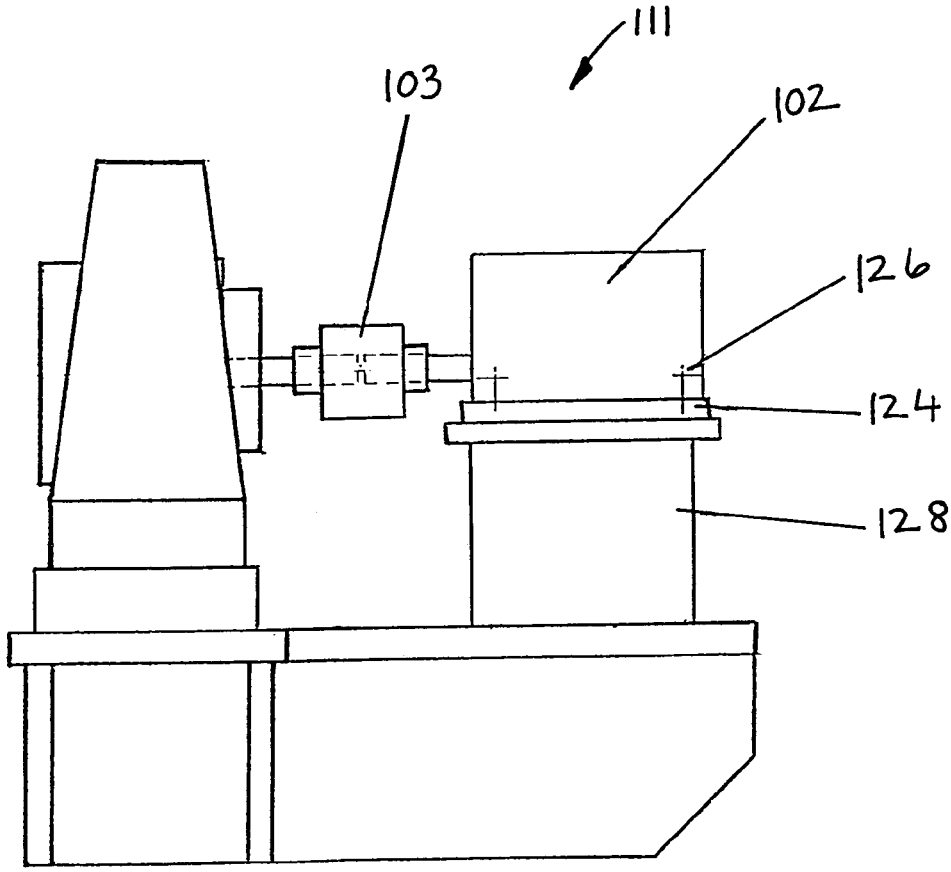
FIG. 4 illustrates a rotary limit switch assembly according to one embodiment of the present invention.
Figure 5:
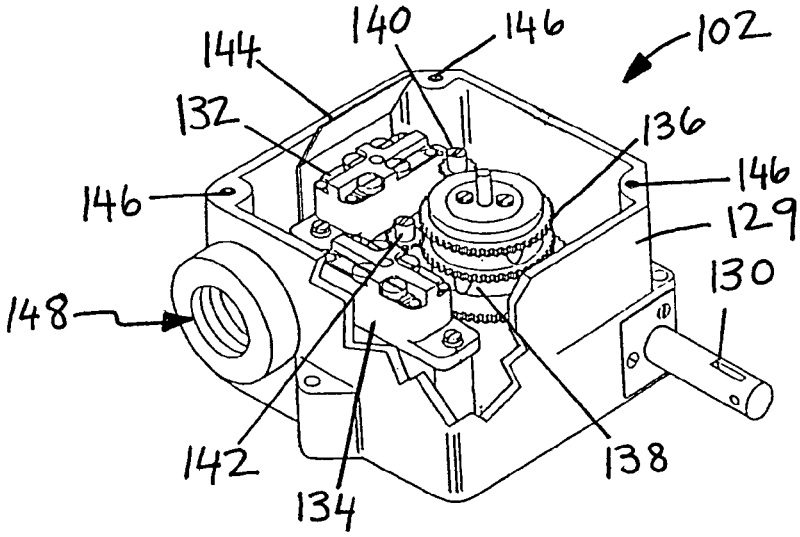
FIG. 5 is a partial perspective view of one embodiment of the rotary limit switch assembly shown in FIG. 4 with a portion of the housing removed to permit viewing of certain internal components.

A more detailed description of the rotary limit switch 102 is provided with reference to FIGS. 4 and 5. Accordingly, turning now to FIG. 4, one embodiment of a rotary limit switch assembly 111 according to the present invention is illustrated. The limit switch assembly 111 may include the rotary switch 102 having two normally open and two normally closed contacts with a 20:1 gear ration. The limit switch assembly 111 also may include the rotary limit switch coupling 103 for interfacing the rotary limit switch 102 with the cable drum 98. In one embodiment of the present invention, the rotary limit switch 102 may be attached to a mounting pad 124 by fasteners 126. The fasteners 126 may include, for example, round head slotted machine screws and split steel lockwashers. The rotary limit switch 102 and the mounting pad 124 may be attached to a stanchion 128 for structural support.

FIG. 5 shows a more detailed view of an embodiment of the rotary limit switch 102. The rotary limit switch 102 may include, for example, a housing 129 and an input shaft 130 for coupling the rotary limit switch 102 to the cable drum 98. The input shaft 130 may be coupled directly to the cable drum 98 or may be coupled to the cable drum 98 by a flexible coupling to eliminate any potential stresses that may be created on the shaft 130 and respective bushings by any misalignments. The rotary limit switch 102 also may include first and second switches referred to respectively as 132 and 134. A first cam 136 and a second cam 138 may trip the first and second switches 132, 134, respectively, after the shaft 130 rotates a predetermined number of revolutions in a given direction of rotation. The two separate trip points for the first and second cams 136, 138 may be adjusted with first and second adjusting pinions 140, 142, respectively. The rotary limit switch 102 also may include an insulating shield 144 to reduce the effects of electrical interference. Electrical wires carry the trip signals to either the vector drive controller system 180 (shown in FIG. 7) or a general purpose controller that interfaces with the vector drive controller system 180 to coordinate the reversing operations with the number of revolutions of the driven cable drum 98 once a trip point limit has been reached. The electrical wires may be provided to the rotary switch 102 through an opening 148 in the housing 129. The rotary limit switch 102 may be mounted through mounting holes 146. In operation, the input shaft 130 drives the adjustable first and second cams 136, 138 through a gear reduction. The first and second cams 136, 138, in turn, operate the contacts of the first and second switches 132, 134, respectively. The rotary limit switch 102 may be configured with various gear reduction ratios. For example, in one embodiment of the invention the gear reduction ratio may be 20:1, such that 20 revolutions of the input shaft 130 is equivalent to one revolution of the first and second cams 136, 138. The rotary limit switch 102 trip signals may be processed by the vector drive controller system 180 (shown in FIG. 7) or a general purpose controller that may be interfaced with it (not shown).

Figure 3C:
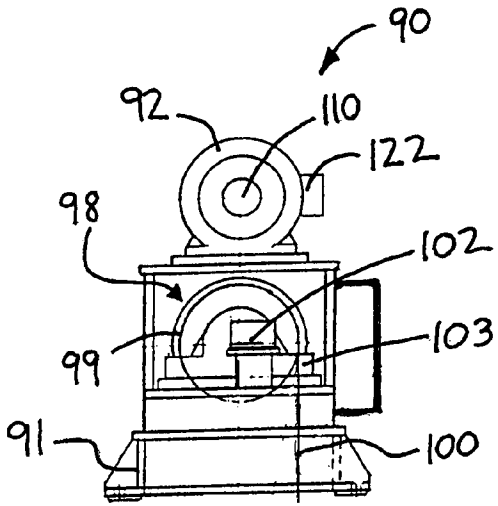
FIGS. 3A, 3B, and 3C illustrate a top view, side view, and front view, respectively, of a motorized hoist assembly according to one embodiment of the present invention.
Figure 3A:
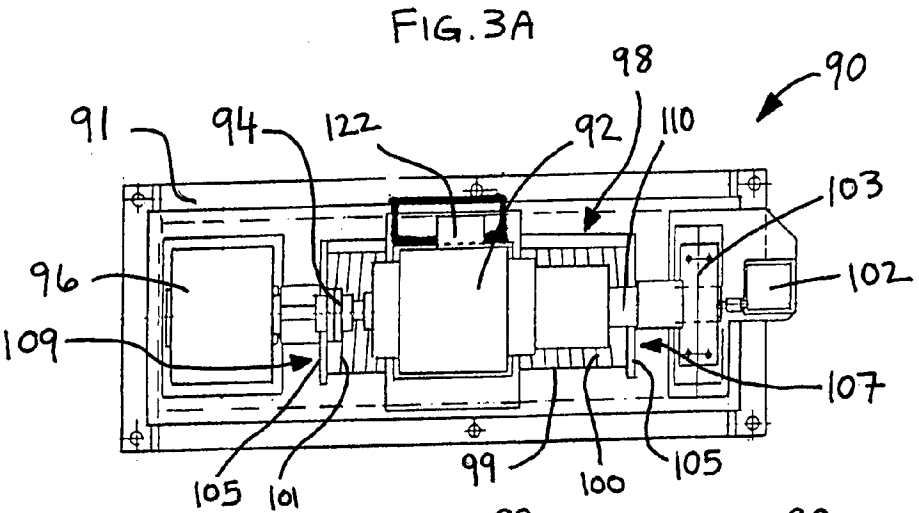
Figure 3B:
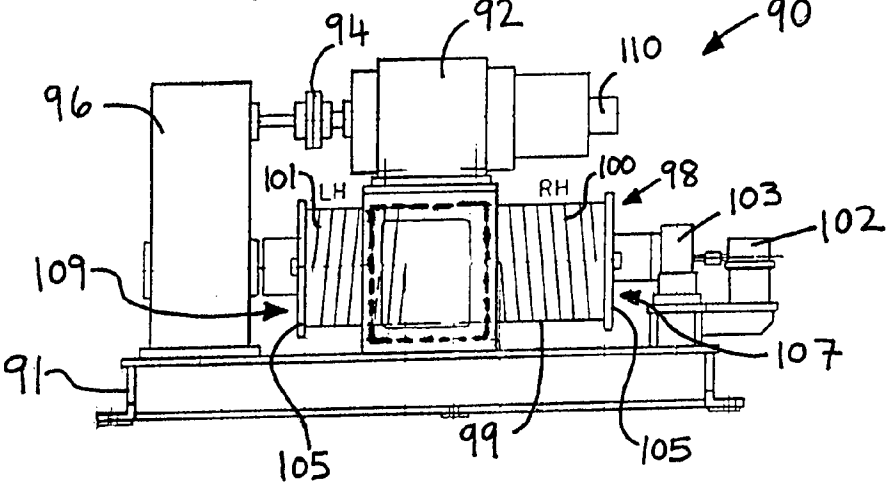

FIGS. 3A, 3B, and 3C show a top view, side view, and front view, respectively, of the motorized hoist assembly 90. In one embodiment, the present invention may include a motor brake 122 for providing standby emergency positive braking in the event of a power failure or drive fault. In one example implementation, the motor brake 122 may provide 75 ft-lbs of torque for braking the AC induction motor 92. The motor brake 122 may be electrically opened and may include a fail-safe operation by a mechanically closed spring. The motor brake 122 may include a brake coil that operates from a 230/460 Volt, 1 Phase, 60 Hz power supply. The motor brake 122 may be provided in a dust-tight and weather proof NEMA-4 enclosure and may be mounted to the front of the AC induction motor 92, for example.

Figure 7:
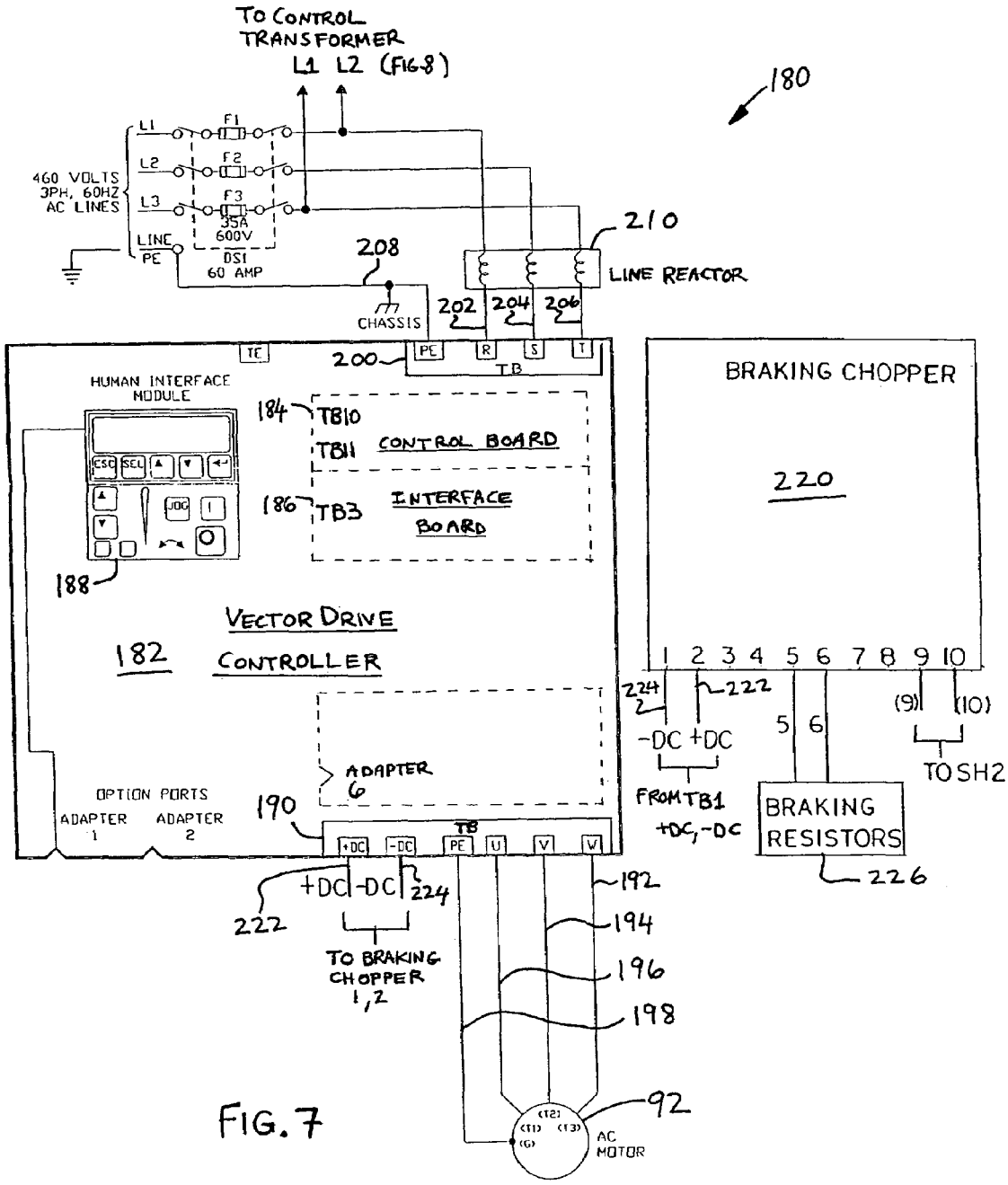
FIG. 7 is a schematic diagram of a flux vector drive control system that may be used for controlling the operation of an AC induction motor according to one embodiment of the present invention.

FIG. 7 is a schematic diagram of one embodiment of a flux vector drive control system 180 ("flux vector drive control system") that may be used for controlling the operation of the AC induction motor 92 according to one embodiment of the present invention. The flux vector drive control system 180 may include an AC flux vector drive controller 182, which may include a control board 184, an interface board 186, and a human interface module 188. In one embodiment of the present invention the AC flux vector drive controller 182 may be an Allen Bradley Model 1336 IMPACT™ AC drive. However, different AC flux vector drive controllers may be employed without departing from the scope of various embodiments of the present invention.

The AC flux vector drive controller 182 may provide precise control of speed and torque of the AC induction motor 92. The AC flux vector drive controller 182 controls the speed output of the AC induction motor 92 by controlling the voltage frequency of the AC voltage applied to the windings of the AC induction motor 92. Controlling the frequency of the applied driving voltage controls the speed of rotation of the radially rotating magnetic stator field. The AC flux vector drive controller 182 controls the torque output of the AC induction motor 92 by controlling the phase of the applied AC voltage relative to the current flowing in the stator of the AC induction motor 92. Alternating current output power may be applied to the AC induction motor 92 windings by the AC flux vector drive controller 182 through terminal board 190 via AC power lines 192, 194 and 196, and ground line 198. Lines 192, 196, and 198 provide the variable frequency AC power to the balanced three-phase AC induction motor 92. Line 198 may be connected to the frame of the AC induction motor 92, or motor frame ground. In one example implementation, the AC flux vector drive controller 182 can supply 15 HP by delivering up to about 27.2 Amps at 460 Volts to the windings of the AC induction motor 92 via lines 192, 194, and 196. In one embodiment of the present invention the AC flux vector drive controller 182 is capable of delivering full torque to the AC induction motor 92 down to zero speed.

Alternating current input power may be applied to the AC flux vector drive controller 182 through a terminal board 200 via lines 202, 204, and 206. Line 208 may be tied to chassis ground. Alternating current input power may be fed to the terminal board 200 via a line reactor 210 (also known as a choke). In one embodiment of the present invention the line reactor 210 may include an Allen Bradley Model A-B/1321-3R25-B. The line reactor 210 may be used to reduce the harmonic currents that may be present in the input AC power supply transformer lines L1, L2, L3 by improving the impedance matching between the AC flux vector drive controller 182 and the transformer that feeds it. The line reactor 210 may also improve reliability when the input lines L1, L2, L3 are subjected to line surges and other disturbances. The line reactor 210 may be sized based on the total current required by the AC flux vector drive controller 182. The input power to the vector drive controller 182 may be supplied via the input lines L1, L2, L3 through fuses F1, F2, F3, respectively. The AC input power supply may vary according to the particular application and type of AC motor used. For example, driving the 15 Horsepower (HP) AC induction motor 92 at 1760 Revolutions Per Minute (RPM), requires a 460 Volt, 3-Phase, 60 Hz AC input power supply. Other motors and other applications may require different AC input power supplies. Accordingly, the scope of the present invention is not intended to be limited to the specific example AC input power supply described herein.

In one embodiment of the present invention, the flux vector drive control system 180 may provide a dynamic braking function for dynamically stopping the AC induction motor 92. To provide such a dynamic braking function, the flux vector drive control system 180 is interfaced with a braking chopper 220 comprising braking resistors 226. These resistors 226 may be provided, for example, by IPC Power Resistor International, Inc. that are designed to interface with Allen Bradley 1336 Series Brake Chopper Modules. When interfaced to the AC flux vector drive controller 182, the dynamic braking resistors 226 produce a braking torque in the AC induction motor 92 during overhauling load conditions. The dynamic braking resistors 226 are connected across the +DC line 222 and the −DC line 224 provided by the flux vector drive control system 180 through the terminal board 190. Those skilled in the art will appreciate that the resistance value in Ohms of the braking resistors 226 determines the amount of braking torque that can be produced and thus the rate at which the AC induction motor 92 will stop. The resistance value may be chosen to be within acceptable limits for the particular AC flux vector drive controller 182 according to the ultimate application. The resistor wattage rating may be sized to prevent overheating during normal braking cycles. For example, high duty applications may require larger (higher wattage rated) resistors. Accordingly, in one example implementation, after reaching a final stop, the braking chopper 220 remains energized until the motorized hoist assembly 90 is electrically energized to run either "up" 118 or "down" 120.

An operator may program the AC flux vector drive controller 182 to control the operation of the AC induction motor 92 by using the human interface module 188. The human interface module 188 may include a joystick for controlling the AC vector drive controller 182. The joystick may provide a 0 to 10 volt output that is converted into a specific AC induction motor 92 speed and torque value by the control logic in the control board 184. The human interface module 188 also may provide one or more pushbutton switches for controlling the operation of the AC flux vector drive controller 182 such as, for example, starting, stopping, reversing, jogging or stepping the AC induction motor 92 motor.

Figure 8:
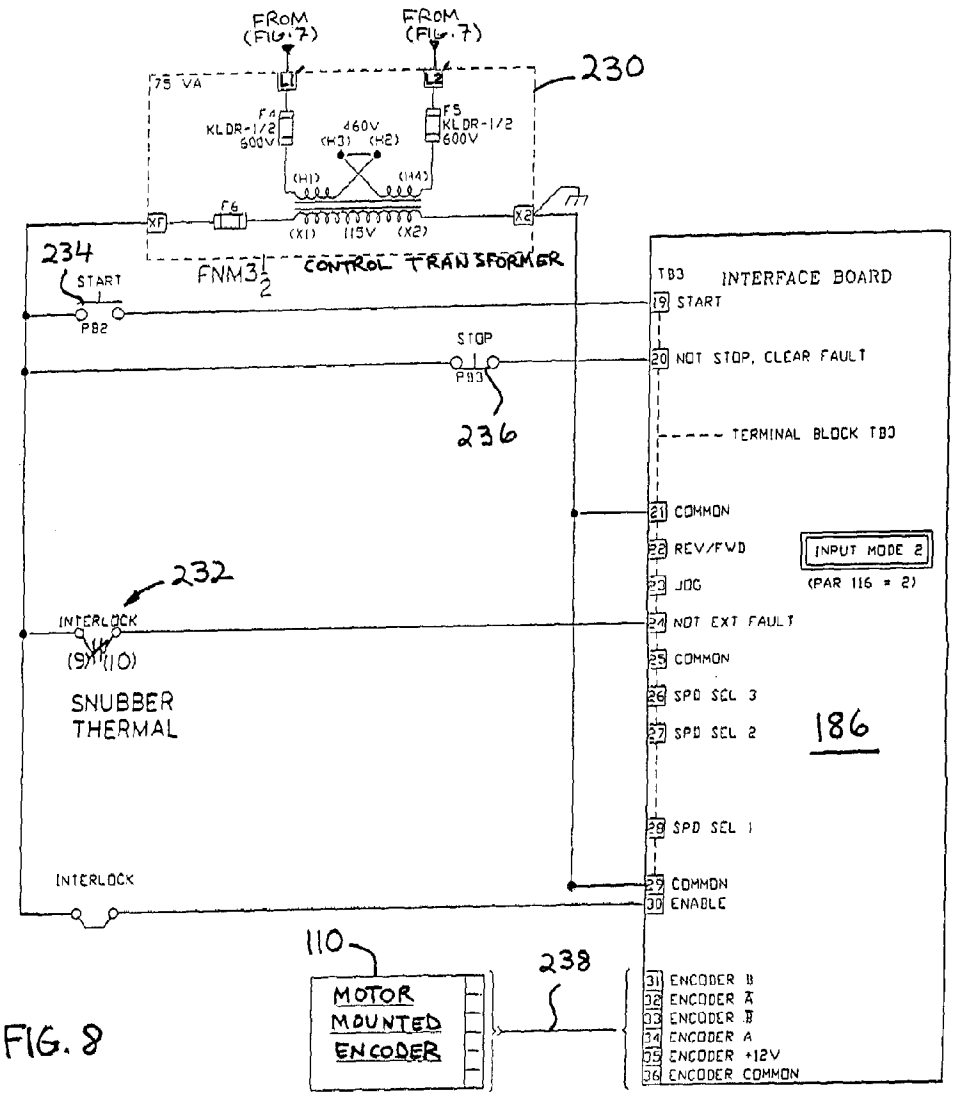
FIG. 8 is a schematic diagram of an interface board of a vector drive controller according to one embodiment of the present invention.

FIG. 8 is a schematic diagram of one embodiment of the interface board 186 of the vector drive controller 182 and one method of connecting the AC flux vector drive controller 182 to the motor mounted rotary encoder 110, a control transformer 230, a thermal snubber circuit 232, a start pushbutton switch 234, and a stop pushbutton 236. The control transformer 230 may receive line power at input lines L1' and L2' from transformer lines L3 and L1 (FIG. 7), respectively. In one example implementation, the control transformer 230 provides 120 Volts of control voltage to the interface board 186. The control transformer 230 may be an isolation transformer that provides a high degree of secondary voltage stability during brief periods of overload conditions generally known as "inrush" current. Switch 234 may be a normally open pushbutton switch that may be used to start the AC induction motor 92 while switch 236 may be a normally closed pushbutton switch that may be used to interrupt or stop the operation of the AC induction motor 92. The thermal snubber circuit 232 may include electrical elements designed to dissipate high electromagnetic transients. The outputs 238 of the motor mounted rotary encoder 110 may interface with the AC flux vector drive controller 182 through the terminals 31-36 of the interface board 186. The rotary encoder 110 may provide a precise measurement of the shaft position of the AC induction motor 92 to the AC flux vector drive controller 182. For example, a rotary incremental encoder may be used to generate a series of pulses, e.g., square waves, whose number of waves can be made to correspond to the actual required mechanical shaft rotation increment of the AC induction motor 92. With the information provided by the rotary encoder 110, the AC flux vector drive controller 182 may provide precise speed and torque control necessary to operate the motorized hoist 90 for grasping and lifting loads with the first and second tongs 12, 14.

Figure 9:
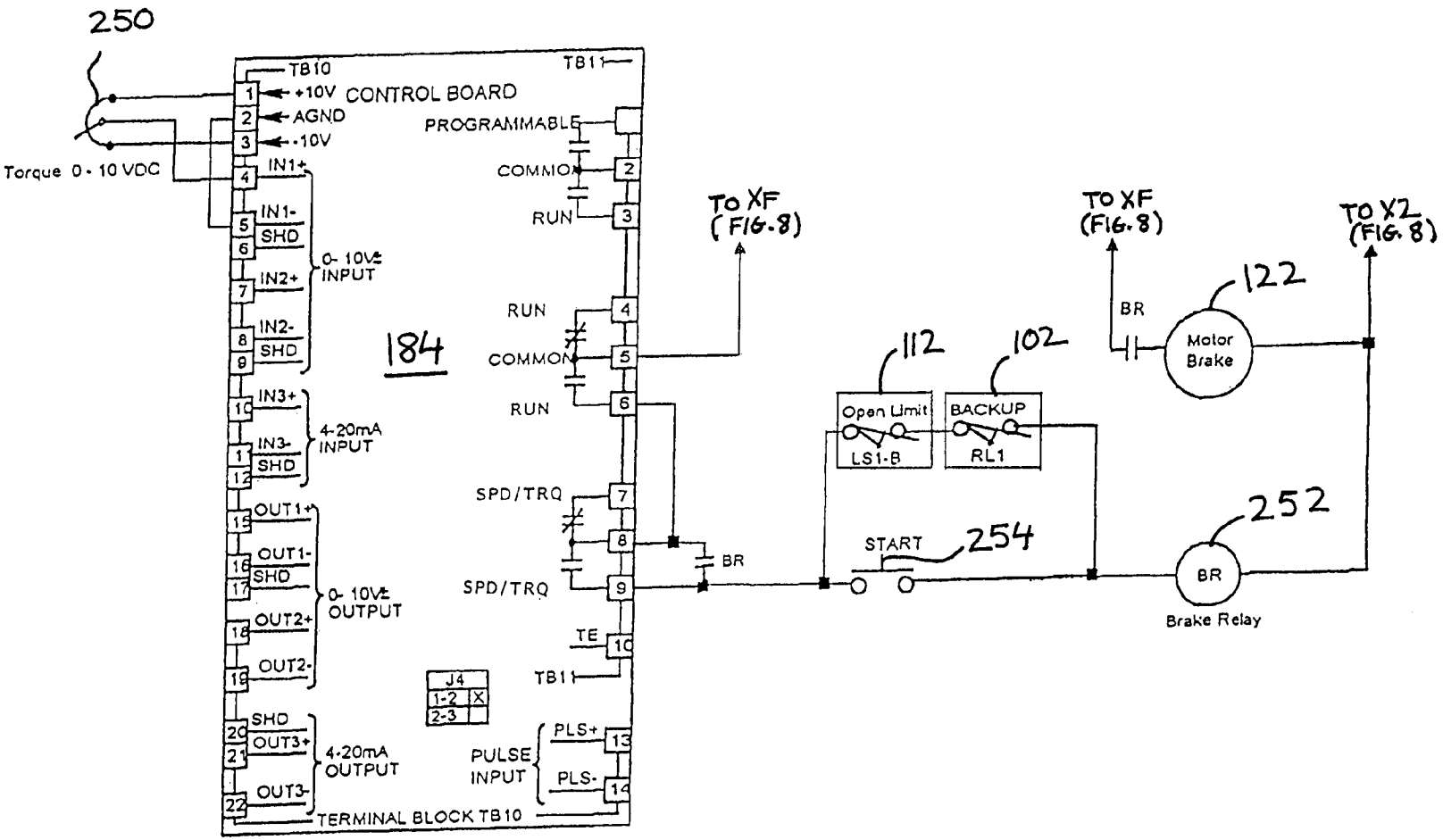
FIG. 9 is a schematic diagram of a control board of a vector drive controller according to one embodiment of the present invention.

FIG. 9 is a schematic diagram of the control board 184 portion of the AC flux vector drive controller 182 and one method of interfacing it with the control joystick 250, the brake motor 122, the brake relay 252, and the limit switches 112, 102 according to one embodiment of the present invention. The joystick 250 may provide, for example, an output signal ranging from 0 to 10 volts. The output signal may correspond to the range of torques to be applied to the load via the first and second tongs 12, 14 by operation of the AC induction motor 92. As described above, in one embodiment of the present invention, the motorized lifter 10 also may include the limit switch 112 for providing a signal indicating that the first and second tongs 12, 14 have reached the fully opened position 74. This occurs when the top beam 82 has reached an extreme "up" position when moving in the "up" direction 118. Accordingly, the limit switch 112 may indicate when the motorized lifter 10 has reached an extreme "up" position, also referred to as the "home position." One set of limit switch 112 contacts may set the motor brake 122 through the brake relay 252 and de-energize the AC induction motor 92. The operation of the backup travel limit switch 102 is for coordinating reversing operations of the AC induction motor 92 with the number of revolutions of the driven cable drum 98.

Figure 10:
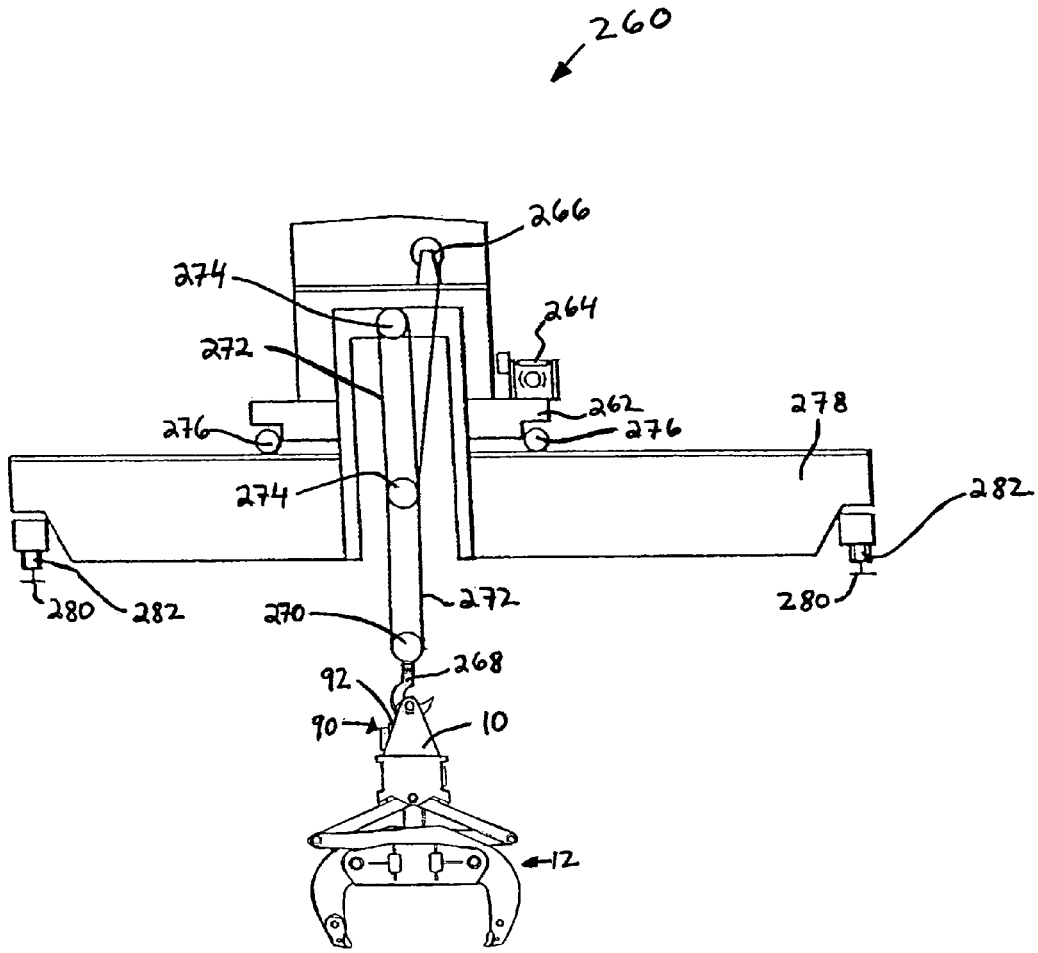
FIG. 10 illustrates an overhead traveling crane in accordance with one embodiment of the present invention.

FIG. 10 illustrates one embodiment of an overhead traveling crane 260 in accordance with one embodiment of the present invention. The crane 260 may include the motorized lifter 10 having at least one set of tongs 12 for engaging a load, the motorized hoist 90, and the AC induction motor 92. The crane 260 also may include a crab 262, a brake 264 for a motor moving the crab 262 (not shown), and a motor 266 for lowering and raising the motorized lifter 10 over the load. The motorized lifter 10 is connected to a crane hook 268, which is connected to a pulley 270. The pulley 270 can be raised and lowered by the motor 266 with wire ropes 272 and drums 274. The crab 262 may have four wheels 276 for moving along a girder 278 in a transverse direction across the crane 260. The girder 278 can move along overhead tracks 280 on wheels 282 in a conventional manner.

Having described each component of the motorized lifter 10 and the flux vector drive control system 180, a summary of the operation of one embodiment of a method of handling a load using the motorized lifter 10 in accordance with one embodiment of the present invention will now be described with reference to FIG. 11. In one embodiment of the present invention the motorized lifter 10 operates under an AC flux vector drive controller 182 controlled AC induction motor 92 for synchronously opening and closing the first and second tongs 12, 14 against a load to be lifted, supported, and carried by the overhead traveling crane 260. The AC flux vector drive controller 182 provides smooth acceleration and deceleration ramps to the AC induction motor 92 in both the opening 71 and closing 73 modes. These modes may be field adjustable to obtain the most desirable action of the motorized lifter 10. When the first and second tongs 12, 14 close, or nearly close, on a load, an operator switches the AC flux vector drive controller 182 into torque mode. The torque mode of the AC flux vector drive controller 182 may be invoked by energizing one or more relays. An operator may do this by activating a pushbutton switch. A predetermined, adjustable, torque level may be selected such that it can be overridden to allow the wire ropes 100, 101 to be pulled off the cable drum 98 of the motorized hoist 90. This action may take place as the overhead traveling crane 260 hoist starts to lift the motorized lifter 10 and thus initiates the final self-pressing closure of the first and second tongs 12, 14 against the load. This mode of operation may be maintained until such time that the opening cycle of the tongs 12, 14 is energized in order maintain a load on the wire ropes 100, 101 to keep them in place.

Figure 11:
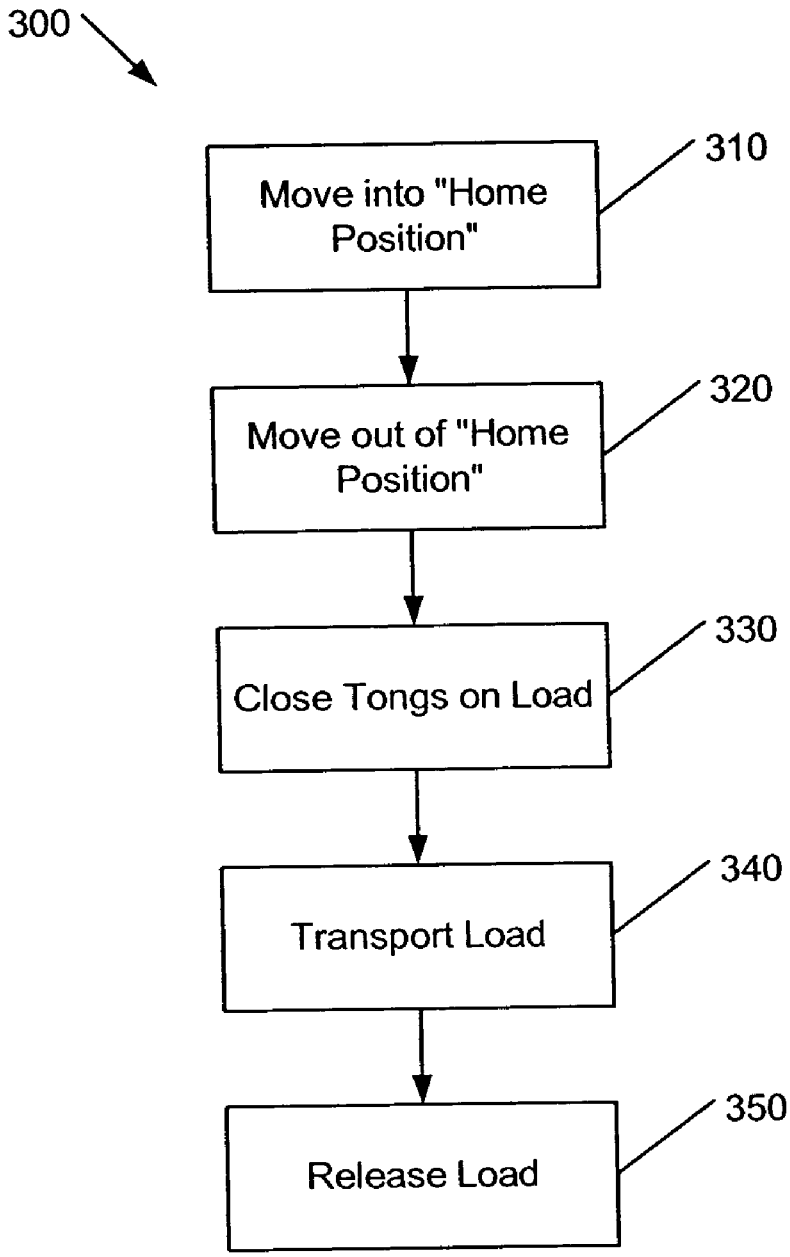
FIGS. 11-14 are flow diagrams of methods for operating a motorized lifter in accordance with several non-limiting embodiments of the present invention.

Accordingly, FIG. 11 is a flow diagram of one embodiment of a method according to the present invention, and is referred to generally at 300. The method may be used for operating the motorized lifter 10 in accordance with one embodiment of the present invention for handling, e.g., grasping, lifting, and transporting, a load. Furthermore, although the method 300 is described with respect to a remote controlled manual sequence of operation, the scope of the present invention is intended to cover an automatic computerized remote controlled sequence of operation as well.

Accordingly, initially at block 310 the motorized lifter 10 is placed into the "home position" by using the joystick 250 to control the voltage signal applied to terminals 4 and 5 of the control board 184. In one embodiment of the present invention, to place a control signal for operating the AC induction motor 92 may be provided to the vector drive controller 182 by the joystick 250. For example, the joystick 250 may be used to provide an input voltage signal ranging from 0 to 10 Volts to the terminals 4 and 5, wherein 10 Volts is equivalent to setting the tongs 12, 14 into a fully opened position 74 by raising the bottom beam 84 in the "up" direction 118. Conversely, reducing the input voltage with the joystick 250 from 10 Volts, continuously closes the first and second tongs 12, 14 by lowering the bottom beam 84 in the "down" direction 120 until the tongs 12, 14 contact the load or reach the minimum closed position 78. At block 320, the motorized lifter 10 is moved out of the "home position." At block 330, the first and second tongs 12, 14 are closed against the load.

At block 340 the load is transported to a desired location. While transporting the load, throughout all movements of the motorized lifter 10 while transporting the load, the joystick 250 may remain at a zero output voltage position. This will enable the tongs 12, 14 to maintain the pre-set torque level condition against the load while transporting it to the desired location.

At block 350 the load is released. Once the load has been transported to the desired location and has been set on a desired surface such as, for example, a floor or a vehicle, in order to release the load, the operator may move the joystick 250 from its zero volts output position to a higher output voltage position as may be required to reach a desired open position to release the load from the grab of the first and second tong 12, 14. At this point, the operator may decide to open the first and second tongs 12, 14 to the fully open 74 "home position." When the first and second tongs 12, 14 are at the fully open position 74, the AC induction motor 92 may be de-energized and the brake motor 122 may be set. This may allow the AC induction motor 92 to cool. It is not necessary, however, to take the first and second tongs 12, 14 to the fully open position 74 in order to release the load. Accordingly, the tongs 12, 14 may remain in an intermediate position where they will remain in an open position.

Figure 12:
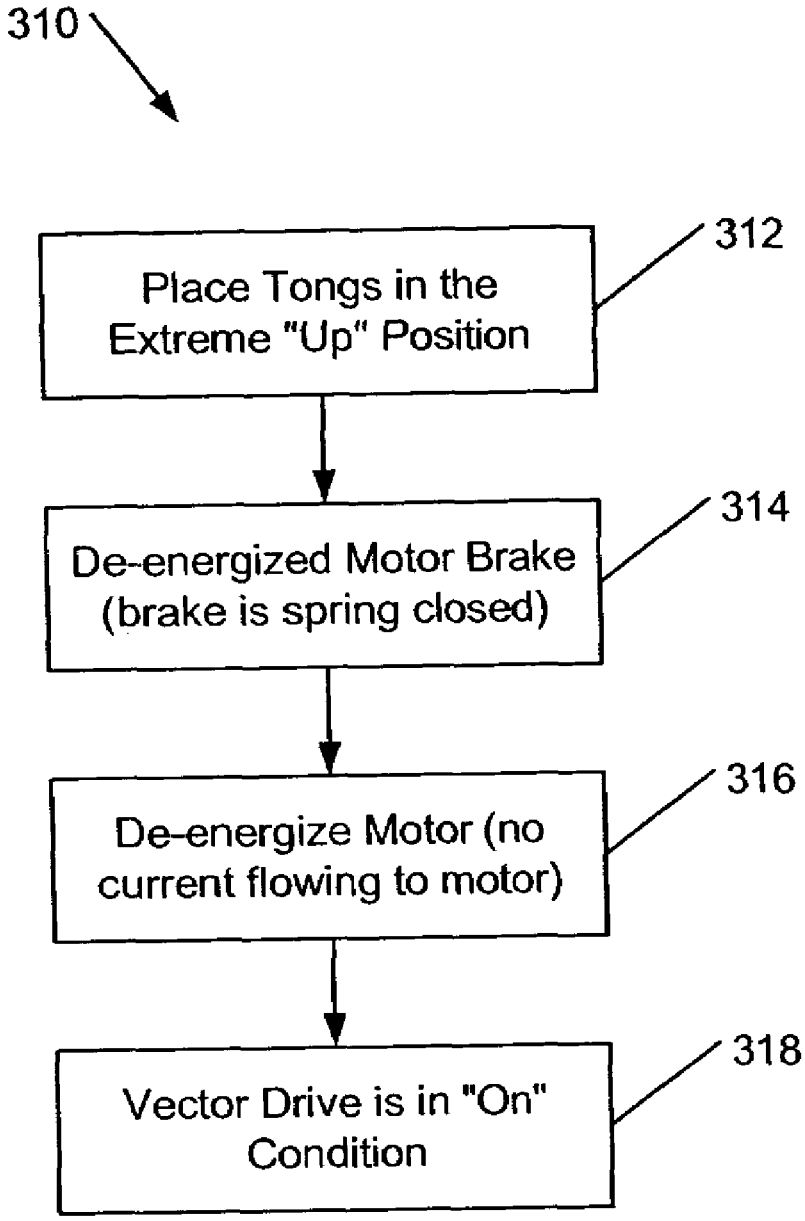

Turning now to FIG. 12, in order to move the tongs 12, 14 into the "home position" as described with reference to block 310, at block 312 the first and second tongs 12, 14 are located in an extreme "up" position and the first and second tongs 12, 14 are at their maximum open position 74 for receiving the load. At block 314, the motor brake 122 is de-energized (e.g., the brake spring is closed) and at block 316 the AC induction motor 92 is de-energized (e.g., no current is flowing out of terminal board 190 from the AC flux vector drive controller 182 into the AC induction motor 92 through lines 192, 194, and 196). At block 318 the vector drive controller 182 is placed in an "on" condition.

Figure 13:
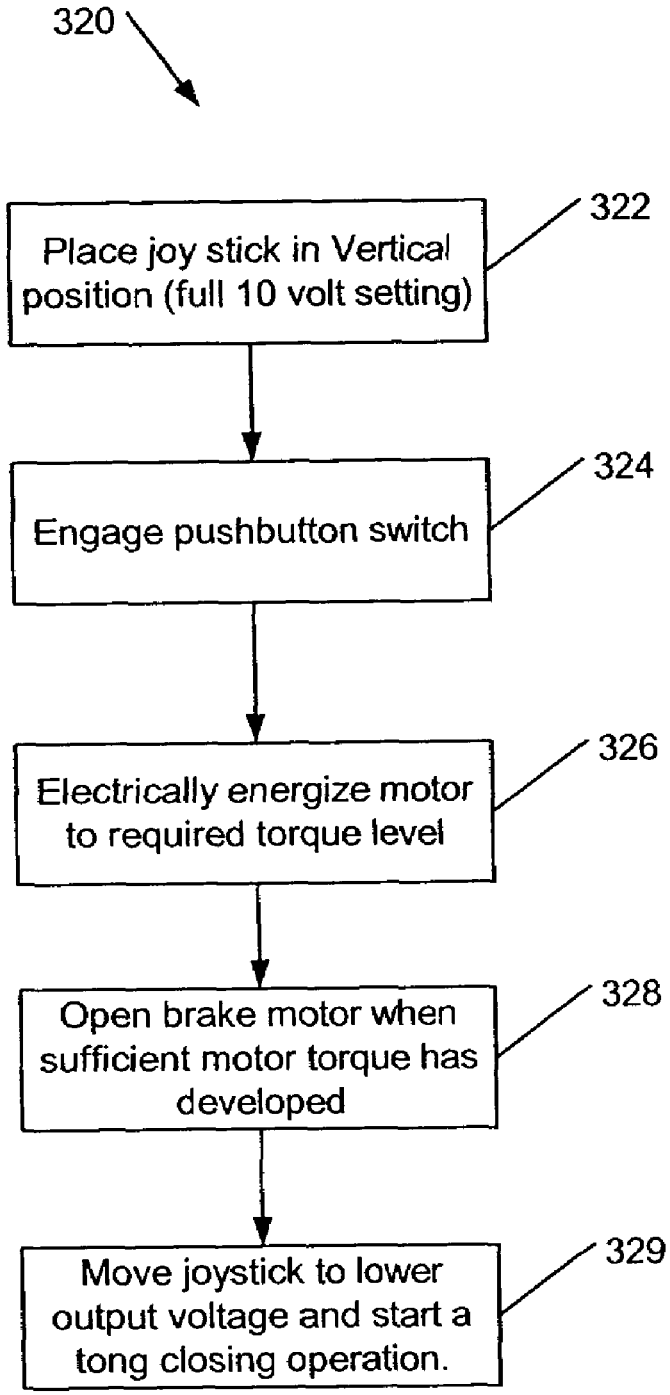

Turning now to FIG. 13, once the tongs are ready to move out of the home position as described with reference to block 320, in one embodiment of the present invention, at block 322 a full control voltage of 10 volts is applied to terminals 4 and 5 of the control board 184. In one embodiment of the present invention the voltage is controlled with the joystick 250. Nevertheless, the voltage may be applied to the terminals 4 and 5 by a computerized process. Once the joystick 250 is placed in a vertical position to supply a full 10 Volt output, at block 324 the operator engage the first pushbutton switch 234 to energize the AC induction motor 92 to a predetermined torque required to hold the first and second tongs 12, 14 at block 326. In one example implementation of the invention, the pushbutton start switch 234 may be located on the same housing as the joystick 250.

Furthermore, in one example implementation, at block 326 the required torque to hold the first and second tongs 12, 14 for a 160,000 lbs. capacity motorized lifter 10 is applied. The required torque may vary, among other things, as a function of the lifting capacity of the motorized lifter 10 and the weight of the first and second tongs 12, 14, for example. At block 328, once the AC induction motor 92 is energized to the predetermined torque, the motor brake 122 is allowed to open when sufficient motor torque has developed. A second pushbutton switch 254 may be used to control this function (see FIG. 8). At block 329, while still holding the pushbutton start switch 234 in a closed contact position, the operator may use the joystick 250 to begin a closing operation by moving the first and second tongs 12, 14 inwardly against the load. Once the first and second tongs 12, 14 have closed inwardly enough to trigger the limit switch 112 and de-energize the cab-mounted pilot light and the limit switch has reset, the operator may release the pushbutton start switch 254. Accordingly, the operator then may control the speed of both opening and closing tong-positioning operations of the first and second tongs 12, 14 using only the joystick 250. Due to its analog nature, the joystick 250 provides infinite control resolution for opening and closing tong 12, 14 positioning operations.

Figure 14:
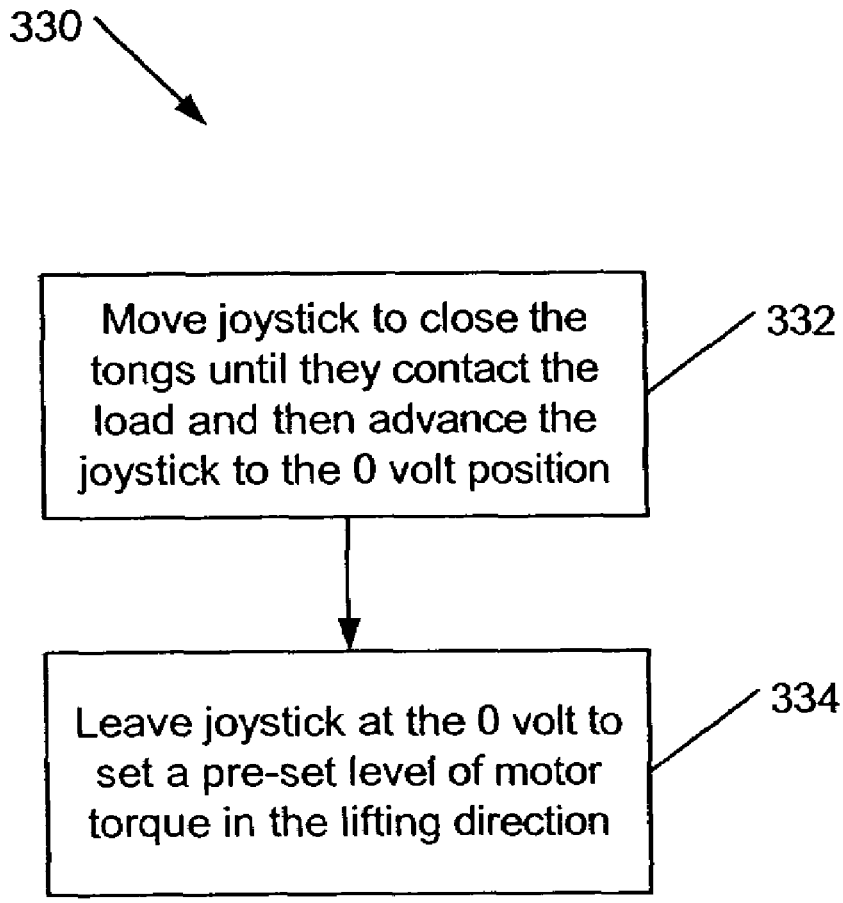

Turning now to FIG. 14, once the first and second tongs 12, 14 are closed against the load as described with reference too block 330, at block 332 the operator closes the first and second tongs 12, 14 using the joystick 250 until they contact the load by reducing the input voltage applied to terminals 4 and 5 of the control board 184. The voltage may be reduced continuously until the first and second tongs 12, 14 close enough to contact the load. Once the first and second tongs 12, 14 contact the load, the operator may adjust the joystick 250 to output 0 volts and keep the joystick in that position until the load is to be released. In one example implementation, at block 334 the 0 volt joystick 250 position sets a predetermined level of torque output by the AC induction motor 92 when the first and second tongs 12, 14 are moved in the "up" 118 lifting direction. The predetermined torque level setting may respond in real time to any wire rope 100, 101 loading that is less than the predetermined ("pre-set") torque level. This may substantially eliminate the possibility of developing any slack in the wire rope 100, 101. Conversely, the pre-set level of torque setting can be overhauled as the main crane 260 hoist begins to lift the motorized lifter 10 by the bails 19, 19' and further closes the first and second tongs 12, 14 on the load while lifting the load.

Although the motorized lifter 10 according to one embodiment of the present invention has been described to operate with slab tongs, the scope of the present invention is not intended to be limited thereto. Accordingly, the AC induction motor 92 operated motorized lifter 10 may be employed in a variety of applications where a set of grabs may be operated by an AC induction motor 92 to grab, lift or transport a load. Accordingly, the AC induction motor 92 operated motorized lifter 10 in accordance with the present invention as described above may be modified and adapted to work with lifting systems other than the slab tong system described above. Such applications may include, among others, the motorized operation of supporting tongs, gripping tongs, pressure tongs, bale grabs, pipe grabs, inner diameter coil tong, automatic latching tongs, drum lifters, automatic rotating ingot tongs, automatic round ingot tongs, automatic ingot tongs, automatic die block tongs, automatic vertical coil tongs, automatic double vertical tongs, automatic double gripping single vertical tongs, automatic inside coil tongs, motorized rack and pinion coil grabs, single coil c-hook grabs, double coil c-hook grabs, wide range automatic slab tongs, automatic single slab tongs, hoist operated slab tongs, hydraulic slab tongs, automatic spreader slab tongs, truck mounted hydraulic slab tongs, automatic roll tongs, automatic double roll tongs, motorized double roll tongs, motorized backup roll lifters, motorized single roll lifters, and/or pallet lifters.

Furthermore, the scope of the present invention is not limited to specific embodiments of the invention having particular characteristics such as weight, lifting capacity, maximum and minimum openings, maximum and minimum load dimensions, and the like. Also, the present invention may include embodiments having a single lever, a single pair of levers or tongs, or a plurality of levers or tongs operable in concert under the control of a single AC induction motor 92 and the AC flux vector drive controller 182, or operable individually under the control of a plurality of AC induction motors 92 and vector drive controllers 182, or any combination thereof.

Those of ordinary skill in the art will recognize that many modifications and variations of the present invention may be implemented. The foregoing description and the following claims are intended to cover all such modifications and variations. Furthermore, the materials and processes disclosed are illustrative, but are not exhaustive. Other materials and processes may also be used to make devices embodying the present invention.

The invention claimed is:

1. A lifter, comprising:

tongs, comprising:

a set of levers configured with a scissors style linkage;

first and second opposing arms having first and second distal ends; and first and second straight link members pivotally coupled to the first and second opposing arms;

an electric motor operatively coupled with the tongs for actuating the tongs; and a vector drive controller electrically coupled to the electric motor for controlling the operation of the motor, wherein the motor controls the opening and closing of the tongs.

2. The lifter of claim 1, wherein the electric motor is an alternating current ("AC") induction motor.

3. The lifter of claim 1, wherein the electric motor is a direct current ("DC") motor.

4. The lifter of claim 1, wherein the set of levers comprise:

first and second levers formed integrally with the first and second opposing arms and each lever includes proximate ends; and pivotally movable junctures located at each proximate end.

5. The lifter of claim 4, further comprising first and second straight link members each including a proximate end and a distal end, wherein the proximate end of the first lever is pivotally attached to the distal end of the second straight link member and the proximate end of the second lever is pivotally attached to the distal end of the first straight link member by first and second pivot pins located at the respective pivotally movable junctures located at each proximate end of the first and second levers.

6. The lifter of claim 5, wherein the proximate ends of the first and second straight link members are pivotally attached by a third pivot pin.

7. The lifter of claim 1, further comprising a cross bar pivotally attached to the first and second opposing arms.

8. The lifter of claim 1, further comprising first and second jaw elements attached to the first and second distal ends of the first and second opposing arms.

9. The lifter of claim 8, wherein the first and second jaw elements further comprise first and second tong points adapted for contacting and frictionally engaging a load gripped therebetween.

10. The lifter of claim 1, wherein the first and second arms move synchronously in the open position and in the closed position by operation of the electric motor.

11. The lifter of claim 1, further comprising second tongs mechanically coupled to the tongs, wherein the first and second set of tongs are synchronously actuated into the open and the closed positions by the electric motor.

12. The lifter of claim 1, further comprising an encoder coupled to the electric motor for obtaining a measurement of the position of a shaft of the electric motor.

13. The lifter of claim 12, wherein the measurement of the position of the shaft is provided to the vector drive controller as a feedback control signal.

14. The lifter of claim 12, wherein the encoder includes a rotary incremental encoder.

15. The lifter of claim 14, wherein the rotary incremental encoder generates a series of pulses corresponding to the required rotation increment of the shaft.

16. The lifter of claim 1, wherein a shaft of the electric motor is coupled to a gear reducer.

17. The lifter of claim 16, wherein the gear reducer comprises a drive train including a triple reduction gear speed reducer.

18. The lifter of claim 16, wherein the gear reducer includes a helical gear reducer.

19. The lifter of claim 1, wherein a shaft is coupled to a cable drum comprising a drum barrel having first and second ends and flanges located at the first and second ends.

20. The lifter of claim 19, wherein the cable drum comprises left-hand and right-hand grooves for accommodating first and second wire ropes extending from the cable drum to a load block assembly that is operatively connected to the tongs.

21. The lifter of claim 20, wherein the tongs and the load block assembly are both rigidly attached to a support beam.

22. The lifter of claim 19, wherein the vector drive controller is coupled to a back-up travel rotary limit switch for coordinating reversing operations with a number of revolutions of the cable drum.

23. The lifter of claim 1, wherein the vector drive controller is coupled to a limit switch for indicating when the first tongs have reached a predetermined position.

24. The lifter of claim 1, further comprising a motor brake coupled to the vector drive controller.

25. The lifter of claim 1, wherein the vector drive controller controls the speed of the electric motor by controlling a voltage applied to one or more windings of the electric motor.

26. The lifter of claim 1, wherein the vector drive controller controls the torque of the electric motor by controlling a phase voltage relative to a current flowing in a stator portion of the electric motor.

27. The lifter of claim 1, further comprising a braking chopper coupled to the vector drive controller for dynamically braking the electric motor.

28. A lifter, comprising:

tongs comprising a set of levers attached to vertically spaced apart top and bottom transverse beams for supporting the tongs;

second tongs mechanically coupled to the tongs by the bottom beam; and a motorized hoist assembly attached to the top beam for synchronously controlling the opening and closing of the tongs;

wherein the motorized hoist further comprises:

an electric motor having a stator, a rotor, and one or more windings and a shaft operatively coupled with the tongs for actuating the tongs to an open position and actuating the tongs to a closed position; and a vector drive controller electrically coupled to the electric motor for controlling the operation of the electric motor.

29. The lifter of claim 28, wherein the electric motor is an alternating current ("AC") induction motor.

30. The lifter of claim 28, wherein the electric motor is a direct current ("DC") motor.

31. The lifter of claim 28, wherein the shaft is coupled to a cable drum comprising a drum barrel having first and second ends and flanges located at the first and second ends.

32. The lifter of claim 31, wherein the cable drum comprises left-hand and right-hand grooves for accommodating first and second wire ropes extending from the cable drum to a load block assembly that is operatively connected to the tongs.

33. The lifter of claim 32, wherein the load block assembly is rigidly attached to the bottom beam.

34. The lifter of claim 31, wherein the vector drive controller is coupled to a back-up travel rotary limit for coordinating reversing operations with a number of revolutions of the cable drum.

35. An overhead traveling crane, comprising:

a motorized lifter;

wherein the motorized lifter further comprises:

tongs attached to vertically spaced apart top and bottom transverse beams for supporting the tongs;

second tongs mechanically coupled to the tongs by the bottom beam; and a motorized hoist assembly attached to the top beam for synchronously controlling the opening and closing of the tongs;

wherein the motorized hoist further comprises:

an electric motor having a stator, a rotor, and one or more windings and a shaft operatively coupled with the tongs for actuating the tongs to an open position and actuating the tongs to a closed position; and a vector drive controller electrically coupled to the electric motor for controlling the operation of the electric motor.

36. The overhead crane of claim 35, wherein the electric motor is an alternating current ("AC") induction motor.

37. The overhead crane of claim 35, wherein the electric motor is a direct current ("DC") motor.

38. The overhead crane of claim 35, wherein the shaft of the lifter is coupled to a cable drum comprising a drum barrel having first and second ends and flanges located at the first and second ends.

39. The overhead crane of claim 38, wherein the cable drum of the lifter comprises left-hand and right-hand grooves for accommodating first and second wire ropes extending from the cable drum to a load block assembly that is operatively connected to the tongs.

40. The overhead crane of claim 39, wherein the load block assembly of the lifter is rigidly attached to the bottom beam.

41. The overhead crane of claim 38, wherein the vector drive controller of the lifter is coupled to a back-up travel rotary limit for coordinating reversing operations with a number of revolutions of the cable drum.

42. A method of handling a load with a motorized lifter including at least one set of tongs and an electric motor coupled to the tongs, the method comprising:

moving the tongs of the motorized lifter to a home position by operation of the electric motor coupled to the tongs, wherein the electric motor is controlled by a vector drive controller;

moving the tongs out of the home position;

placing the tongs over the load; and positioning the tongs against the load by operation of the vector drive controlled electric motor so as to frictionally engage the load with the tongs;

wherein moving the tongs out of the home position further comprises:

placing the vector drive controller in an "on" position;

applying a full voltage signal output to the vector drive controller; and activating a start pushbutton switch.

43. The method of claim 42, wherein the electric motor is an alternating current ("AC") induction motor.

44. The method of claim 42, wherein the electric motor is a direct current ("DC") motor.

45. The method of claim 42, wherein the opening the tongs to a fully open position further comprises:

energizing the electric motor;

providing a control signal to the vector drive controller for actuating the electric motor to place the tongs in an extreme up position;

de-energizing a motor brake; and de-energizing the electric motor.

46. The method of claim 42, wherein activating the start pushbutton switch further comprises:

electrically energizing the electric motor to a torque level required to maintain the tongs in an open position;

opening the brake motor when sufficient motor torque has developed; and while the start pushbutton switch is still activated, initiating a close tongs operation and de-activating the start pushbutton switch.

47. The method of claim 42, wherein positioning the tongs on the load further comprises:

applying a control signal until the tongs contact the load; and when the tongs contact the load, adjusting the control signal to a zero volt output.

48. The method of claim 47, further comprising automatic cable payout without over tensioning for eliminating any slack in a wire rope if a current electric motor torque setting is greater than the wire rope loading.

49. The method of claim 42, further comprising transporting the load.

50. The method of claim 49, further comprising maintaining the control signal output to a zero volt setting throughout all movement of the load.

51. The method of claim 42, further comprising releasing the load.

52. The method of claim 51, wherein releasing the load further comprises adjusting the control signal from a zero voltage output setting to a control voltage output setting until the tongs reach a desired open position to release the load.

* * * * *